United States Patent [19]

Chasen

[11] Patent Number: 4,577,900

[45] Date of Patent: Mar. 25, 1986

[54] SELF ADJUSTING TONGS

[75] Inventor: Lee R. Chasen, Port Chester, N.Y.

[73] Assignee: Coats & Clark, Inc., Stamford, Conn.

[21] Appl. No.: 720,579

[22] Filed: Apr. 8, 1985

[51] Int. Cl.[4] ..... B25B 5/04

[52] U.S. Cl. ..... 294/118; 294/16

[58] Field of Search ..... 294/118, 106, 104, 7, 294/8, 8.5, 11, 16, 25, 28, 29, 49, 50.6, 50.8, 50.9, 55.5; 56/400.12, 400.17; 30/194, 232, 193, 260

[56] References Cited

U.S. PATENT DOCUMENTS

| | | | |
|---|---|---|---|
| 1,104,470 | 7/1914 | Bilson | 294/118 |
| 2,087,758 | 7/1937 | Friend | 294/118 |
| 2,961,683 | 11/1960 | Meyer | 294/118 |

*Primary Examiner*—James B. Marbert

*Attorney, Agent, or Firm*—Burgess, Ryan & Wayne

[57] ABSTRACT

A pair of self adjusting tongs for household use, particularly for grasping food, wherein the jaws are independently rotatable within a limited angular range about corresponding pivot axes, with each jaw being spring-loaded by an arcuate spring extension of the jaw, the end of the spring extension constituting a loop which surrounds and slides along the corresponding stem of the tongs.

4 Claims, 5 Drawing Figures

SELF ADJUSTING TONGS

BACKGROUND OF THE INVENTION

This invention relates to self adjusting tongs, and is particularly suitable for, but not limited to, tongs for household use in the grasping of food and for other purposes.

Various types of tongs for household use and other purposes are known in the art. Such tongs are exemplified by the following references:

U.S. Pat. No. 3,376,639 S. Pompini

U.S. Pat. No. 2,563,422 T. M. Sabo

U.S. Pat. No. 3,889,995 C. Lin

However, there is need for an inexpensive pair of tongs which is capable of improved grasping of cylindrical or irregularly-shaped objects of varying sizes.

Accordingly, an object of the present invention is to provide improved tongs having self adjusting jaws.

SUMMARY OF THE INVENTION

As herein described, there is provided a pair of self-adjusting tongs, comprising a first stem having a first handle at one end; a first jaw pivotally mounted to the other end of the first stem, for rotation about a first axis transverse to the first stem, said first jaw having an annular grasping portion and a spring portion engaging said first stem; a second stem pivotally mounted to said first stem and having a second handle at one end adjacent the handle of the first stem; a second jaw pivotally mounted to the other end of the second stem, for rotation about a second axis transverse to the second stem, said second jaw having an annular grasping portion and a spring portion engaging said second stem; the spring portions of said first and second jaws interacting with said first and second stems respectively to urge the annular grasping portions of said jaws to rotate about said first and second respective axes through a limited angular range toward each other, while permitting pivoting of said first and second jaws about said first and second axes respectively to enable said jaws to orient themselves in conformity with an object engaged between the jaws when the handles are moved toward each other.

IN THE DRAWING

DETAILED DESCRIPTION

Figure 1:
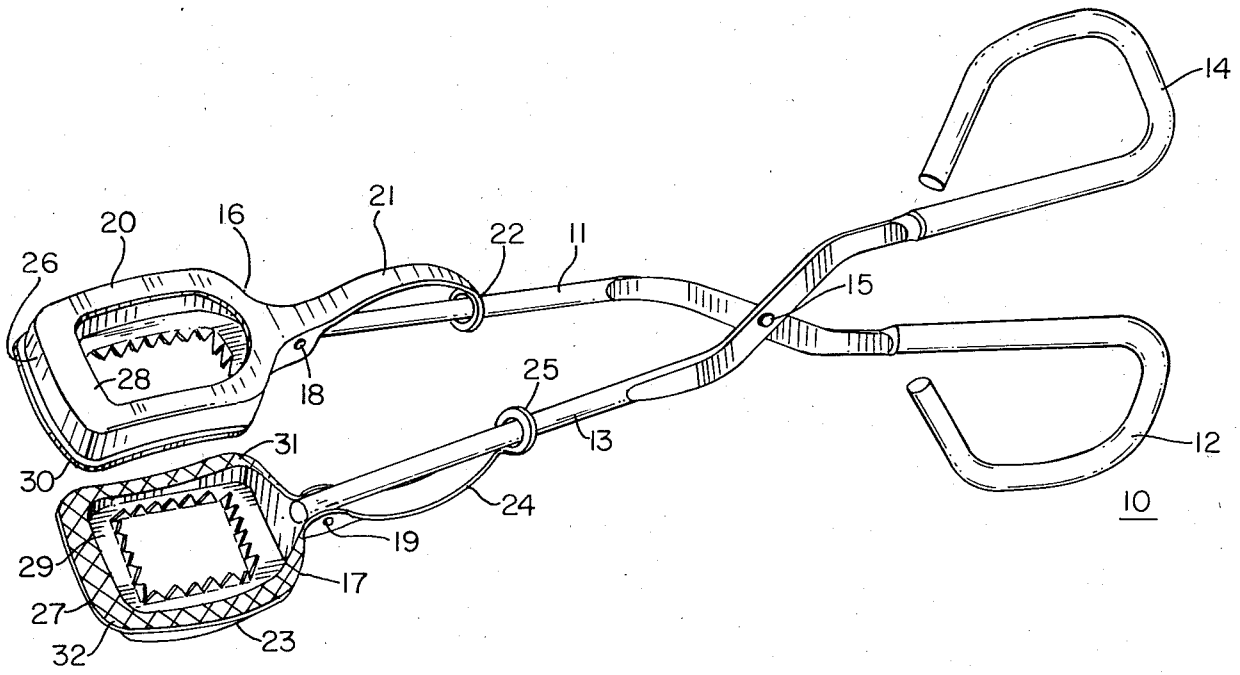
FIG. 1 is a perspective view of a pair of self-adjusting tongs according to a preferred embodiment of the invention, in a partially open position.
Figure 2:
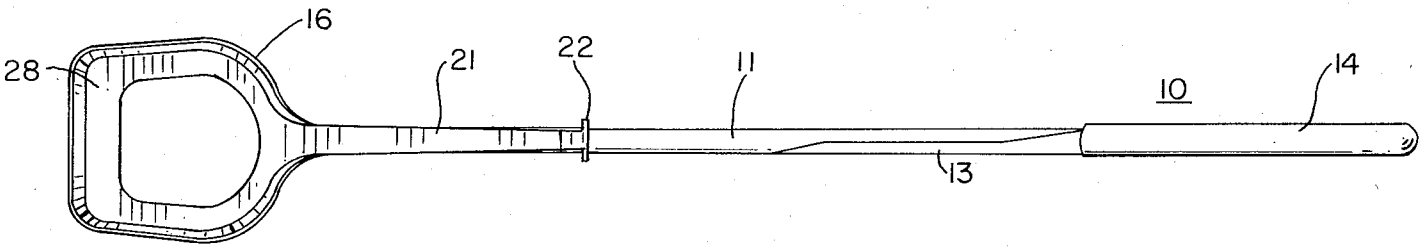
FIG. 2 is a top plan view showing the tongs in closed position, the bottom plan view being identical.
Figure 3:
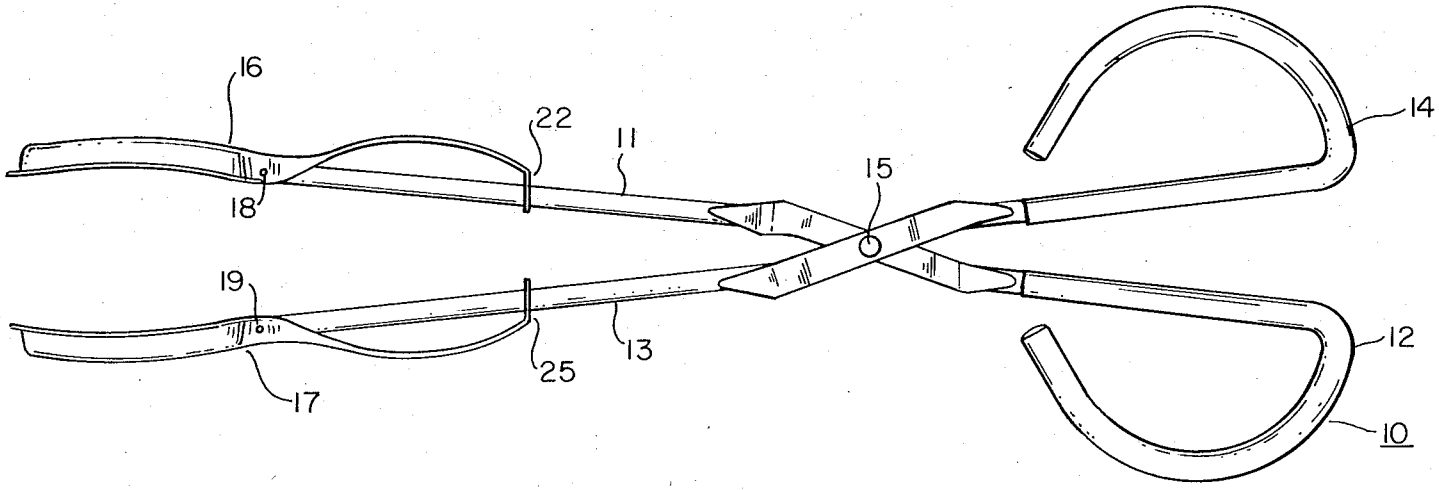
FIG. 3 is a front elevation view thereof, the rear elevation view being a mirror image.
Figure 4:
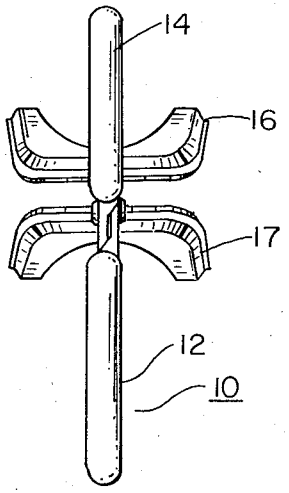
FIG. 4 is a right side elevation view thereof.
Figure 5:
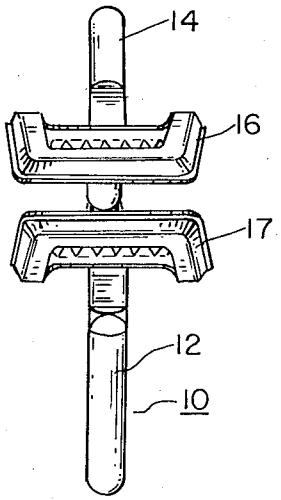
FIG. 5 is a left side elevation view thereof.

As shown in the drawings, and particularly FIG. 1, the self-adjusting tongs 10 comprise a first stem 11 having a first handle 12 at one end thereof, and a second stem 13 having a second handle 14 at one end thereof, adjacent the first handle 12. The stems 11 and 13 are pivotally mounted to each other by means of a pivot pin 15.

A first jaw 16 is pivotally mounted to the other end of the stem 11, by means of a pivot pin 18. Similarly, a second jaw 17 is pivotally mounted to the other end of the stem 13, by means of a pivot pin 19.

The first jaw 16 has an annular grasping portion 20, preferably made of metal, and a spring metal extension 21. The extension 21 extends from the pivot axis 18, which is transverse to the longitudinal dimension of the stem 11, in the direction of the handle 12, and terminates in a loop 22 which surrounds and is slidably movable along the stem 11.

Similarly, the jaw 17, which is preferably but not necessarily identical to the jaw 16, has an annular grasping portion 23 and an arcuate spring metal portion 24 which extends from the transverse pivot pin 19 in the direction of the handle 14, and terminates in a loop 25 which surrounds and is slidably movable along the stem 13.

The spring metal portions 21 and 24 are arcuately shaped so that when the grasping portions 20 and 23 of the jaws 16 and 17 are not in engagement with an object, the loops 22 and 25 are relatively proximate to the pivots 18 and 19, and the jaws 16 and 17 are rotated about the pivots 18 and 19 respectively, through a limited angular range, so as to bring the distal ends 26 and 27 of said jaws relatively close together.

When the handles 12 and 14 are brought toward each other so as to cause the grasping portions 20 and 23 of the jaws 16 and 17 to engage an object, the distal ends 26 and 27 of the jaws are moved away from each other, to cause the jaws to rotate about the axes 18 and 19 so that the curves of the arcuate portions 21 and 24 are flattened, causing the loops 22 and 25 to slide along the stems 11 and 13, away from the pivots 18 and 19.

This rotational movement of the annular grasping portions 20 and 23 of the jaws 16 and 17 enables the jaws to orient themselves in conformity with an object engaged between the jaws when the handles 12 and 14 are moved toward each other.

When the handles 12 and 14 are moved away from each other to release the object from the grasping portions 20 and 23, the spring metal arcuate portions 21 and 24 return to their normal shape, causing the loops 22 and 25 to move toward the pivots 18 and 19, and rotating the grasping portions 20 and 23 of the jaws 16 and 17 so as to again bring the distal ends 26 and 27 thereof closer together, thus facilitating the grasping of another object.

Thus, the grasping portions 20 and 23 of the jaws 16 and 17 are inclined toward each other when the tongs are not in use; and the rotation of said portions results in resilient deformation of the arcuate portions 21 and 24 when the tongs are used, the resiliency of the arcuate portions 21 and 24 serving to return the grasping portions 20 and 23 to their initial orientation after the object grasped thereby is released.

The stems 11 and 13 are preferably made of steel, while the jaws 16 and 17 are preferably stamped from sheet metal having resilient qualities.

The annular grasping portions 20 and 23 of the jaws 16 and 17 have inner recessed parts 28 and 29 and outer raised parts 30 and 31 respectively.

The outer raised parts 30 and 31 of the annular grasping portions 20 and 23 have surfaces knurled to provide a multiplicity of pyramid-shaped elements for providing enhanced grasping action.

A double row of needles (not visible in the drawing) extends from the rasised part 30 in the direction of the annular grasping portion 23; while a similar double row of needles 32 extends from the raised part 31 of the grasping portion 23, toward the grasping portion 20.

What is claimed is:

1. A pair of self-adjusting tongs, comprising:

a first stem having a first handle at one end;

a first jaw pivotally mounted to the other end of the first stem, for rotation about a first axis transverse to the first stem, said first jaw having an annular grasping portion and an arcuate spring portion extending from said first axis in the direction of said first handle, said spring portion terminating in a loop surrounding and slidably movable along said first stem;

a second stem pivotally mounted to said first stem and having a second handle at one end adjacent the handle of the first stem;

a second jaw pivotally mounted to the other end of the second stem, for rotation about a second axis transverse to the second stem, said second jaw having an annular grasping portion and an arcuate spring portion extending from said second axis in the direction of said second handle, said spring portion terminating in a loop surrounding and slidably movable along said second stem;

the spring portions of said first and second jaws interacting with said first and second stems respectively to urge the annular grasping portions of said jaws to rotate about said first and second respective axes through a limited angular range toward each other, while permitting pivoting of said first and second jaws about said first and second axes respectively to enable said jaws to orient themselves in conformity with an object engaged between the jaws when the handles are moved toward each other.

2. The self-adjusting tongs according to claim 1, wherein the annular grasping portion of each of said jaws has a series of peripheral needles extending toward the other jaw.

3. The self-adjusting tongs according to claim 2, wherein the annular grasping portion of each of said jaws has an inner recessed part and an outer raised part, said needles extending from said outer raised part thereof.

4. A pair of self-adjusting tongs, comprising:

a first stem having a first handle at one end;

a first jaw pivotally mounted to the other end of the first stem, for rotation about a first axis transverse to the first stem, said first jaw having an annular grasping portion and a spring portion engaging said first stem;

a second stem pivotally mounted to said first stem and having a second handle at one end adjacent the handle of the first stem;

a second jaw pivotally mounted to the other end of the second stem, for rotation about a second axis transverse to the second stem, said second jaw having an annular grasping portion and a spring portion engaging said second stem;

the spring portions of said first and second jaws interacting with said first and second stems respectively to urge the annular grasping portions of said jaws to rotate about said first and second respective axes through a limited angular range toward each other, while permitting pivoting of said first and second jaws about said first and second axes respectively to enable said jaws to orient themselves in conformity with an object engaged between the jaws when the handles are moved toward each other.

* * * * *